US008485278B2

(12) United States Patent
Mock

(10) Patent No.: US 8,485,278 B2
(45) Date of Patent: Jul. 16, 2013

(54) METHODS AND APPARATUSES FOR INHIBITING ROTATIONAL MISALIGNMENT OF ASSEMBLIES IN EXPANDABLE WELL TOOLS

(75) Inventor: Philip W. Mock, Costa Mesa, CA (US)

(73) Assignee: WWT International, Inc., Anaheim, CA (US)

( * ) Notice: Subject to any disclaimer, the term of this patent is extended or adjusted under 35 U.S.C. 154(b) by 382 days.

(21) Appl. No.: 12/887,389

(22) Filed: Sep. 21, 2010

(65) Prior Publication Data

US 2011/0073300 A1 Mar. 31, 2011

Related U.S. Application Data

(60) Provisional application No. 61/246,955, filed on Sep. 29, 2009, provisional application No. 61/369,637, filed on Jul. 30, 2010.

(51) Int. Cl.
*E21B 23/04* (2006.01)

(52) U.S. Cl.
USPC ..... 175/51; 175/325.1

(58) Field of Classification Search
USPC ..... 175/325.1, 325.5, 51
See application file for complete search history.

(56) References Cited

U.S. PATENT DOCUMENTS

| | | | | |
|---|---|---|---|---|
| 2,141,030 | A | 12/1938 | Clark | |
| 2,167,194 | A | 7/1939 | Anderson | |
| 2,271,005 | A | 1/1942 | Grebe | |
| 2,569,457 | A | 10/1951 | Dale et al. | |
| 2,727,722 | A | 12/1955 | Conboy | |
| 2,783,028 | A * | 2/1957 | Jamison, Jr. | 166/63 |
| 2,946,565 | A | 7/1960 | Williams | |
| 2,946,578 | A | 7/1960 | De Smaele | |
| 3,138,214 | A | 6/1964 | Bridwell | |
| 3,180,436 | A | 4/1965 | Kellner et al. | |
| 3,180,437 | A | 4/1965 | Kellner et al. | |

(Continued)

FOREIGN PATENT DOCUMENTS

| | | |
|---|---|---|
| CA | 2 250 483 | 4/1999 |
| DE | 2439063 | 2/1976 |

(Continued)

OTHER PUBLICATIONS

UK Search Report dated May 25, 2007 for Application GB0704656.8.

(Continued)

*Primary Examiner* — Kenneth L Thompson
(74) *Attorney, Agent, or Firm* — Knobbe Martens Olson & Bear, LLP

(57) ABSTRACT

A gripper for use in a downhole tool is provided. The gripper can include an actuator, an engagement assembly, and an expandable assembly. The engagement assembly can comprise a leaf-spring like elongate continuous beam. The expandable assembly can comprise a linkage including a plurality of links. The linkage can be coupled to the actuator such that the actuator expands the expandable assembly which in turn expands the engagement assembly. One or more keyed connections can inhibit rotational misalignment of the expandable assembly from the engagement assembly. In operation, during one stage of expansion radial forces are transmitted to the engagement assembly through both interaction of a rolling mechanism on the engagement assembly with the expandable assembly and pressure of the linkage assembly directly on an inner surface of the engagement assembly. The one or more keyed connections can preferably facilitate full retraction of the expandable and engagement assemblies.

15 Claims, 12 Drawing Sheets

U.S. PATENT DOCUMENTS 3,185,225 A 5/1965 Ginies
3,224,513 A 12/1965 Weeden, Jr.
3,224,734 A 12/1965 Hill
3,225,843 A 12/1965 Ortloff et al.
3,376,942 A 4/1968 Van Winkle
3,497,019 A 2/1970 Ortloff
3,599,712 A 8/1971 Magill
3,606,924 A 9/1971 Malone
3,661,205 A 5/1972 Belorgey
3,664,416 A 5/1972 Nicolas et al.
3,797,589 A 3/1974 Kellner et al.
3,827,512 A 8/1974 Edmond
RE28,449 E 6/1975 Edmond
3,941,190 A 3/1976 Conover
3,978,930 A 9/1976 Schroeder
3,992,565 A 11/1976 Gatfield
4,040,494 A 8/1977 Kellner
4,085,808 A 4/1978 Kling
4,095,655 A 6/1978 Still
4,141,414 A 2/1979 Johansson
4,274,758 A * 6/1981 Schosek ..... 405/184
4,314,615 A 2/1982 Sodder, Jr. et al.
4,365,676 A 12/1982 Boyadjieff et al.
4,372,161 A 2/1983 de Buda et al.
4,385,021 A 5/1983 Neeley
4,440,239 A 4/1984 Evans
4,463,814 A 8/1984 Horstmeyer et al.
4,558,751 A 12/1985 Huffaker
4,573,537 A 3/1986 Hirasuna et al.
4,615,401 A 10/1986 Garrett
4,674,914 A 6/1987 Wayman et al.
4,686,653 A 8/1987 Staron et al.
4,811,785 A 3/1989 Weber
4,821,817 A 4/1989 Cendre et al.
4,854,397 A 8/1989 Warren et al.
4,951,760 A 8/1990 Cendre et al.
5,010,965 A 4/1991 Schmelzer
5,052,211 A 10/1991 Cohrs et al.
5,090,259 A 2/1992 Shishido et al.
5,169,264 A 12/1992 Kimura
5,184,676 A 2/1993 Graham et al.
5,186,264 A 2/1993 du Chaffaut
5,203,646 A 4/1993 Landsberger et al.
5,310,012 A 5/1994 Cendre et al.
5,316,094 A 5/1994 Pringle
5,363,929 A 11/1994 Williams et al.
5,394,951 A 3/1995 Pringle et al.
5,419,405 A 5/1995 Patton
5,425,429 A 6/1995 Thompson
5,449,047 A 9/1995 Schivley, Jr.
5,467,832 A 11/1995 Orban et al.
5,494,111 A * 2/1996 Davis et al. ..... 166/382
5,519,668 A 5/1996 Montaron
5,542,253 A 8/1996 Ganzel
5,613,568 A 3/1997 Sterner et al.
5,622,231 A 4/1997 Thompson
5,752,572 A 5/1998 Baiden et al.
5,758,731 A 6/1998 Zollinger
5,758,732 A 6/1998 Liw
5,765,640 A 6/1998 Milne et al.
5,794,703 A 8/1998 Newman et al.
5,803,193 A 9/1998 Krueger et al.
5,845,796 A 12/1998 Miller
5,857,731 A 1/1999 Heim et al.
5,947,213 A 9/1999 Angle et al.
5,954,131 A 9/1999 Sallwasser
5,960,895 A 10/1999 Chevallier et al.
5,996,979 A 12/1999 Hrusch
6,003,606 A 12/1999 Moore et al.
6,026,911 A 2/2000 Angle et al.
6,031,371 A 2/2000 Smart
6,089,323 A 7/2000 Newman et al.
6,112,809 A 9/2000 Angle
6,230,813 B1 5/2001 Moore et al.
6,241,031 B1 6/2001 Beaufort et al.
6,273,189 B1 8/2001 Gissler et al.
6,286,592 B1 9/2001 Moore et al.
6,315,043 B1 11/2001 Farrant et al.
6,345,669 B1 2/2002 Buyers et al.
6,347,674 B1 2/2002 Bloom et al.
6,378,627 B1 4/2002 Tubel et al.
6,427,786 B2 8/2002 Beaufort et al.
6,431,291 B1 8/2002 Moore et al.
6,464,003 B2 10/2002 Bloom et al.
6,478,097 B2 11/2002 Bloom et al.
6,601,652 B1 8/2003 Moore et al.
6,640,894 B2 11/2003 Bloom et al.
6,651,747 B2 11/2003 Chen et al.
6,679,341 B2 1/2004 Bloom et al.
6,715,559 B2 4/2004 Bloom et al.
6,745,854 B2 6/2004 Bloom et al.
6,758,279 B2 7/2004 Moore et al.
6,827,149 B2 12/2004 Hache
6,868,906 B1 3/2005 Vail, III et al.
6,910,533 B2 6/2005 Guerrero
6,920,936 B2 7/2005 Sheiretov et al.
6,938,708 B2 9/2005 Bloom et al.
6,953,086 B2 10/2005 Simpson
7,048,047 B2 5/2006 Bloom et al.
7,059,417 B2 6/2006 Moore et al.
7,080,700 B2 7/2006 Bloom et al.
7,080,701 B2 7/2006 Bloom et al.
7,121,364 B2 10/2006 Mock et al.
7,156,181 B2 1/2007 Moore et al.
7,174,974 B2 2/2007 Bloom et al.
7,185,716 B2 3/2007 Bloom et al.
7,188,681 B2 3/2007 Bloom et al.
7,191,829 B2 3/2007 Bloom et al.
7,222,682 B2 5/2007 Doering et al.
7,273,109 B2 9/2007 Moore et al.
7,275,593 B2 10/2007 Bloom et al.
7,303,010 B2 12/2007 de Guzman et al.
7,343,982 B2 3/2008 Mock et al.
7,353,886 B2 4/2008 Bloom et al.
7,392,859 B2 7/2008 Mock et al.
7,401,665 B2 7/2008 Guerrero et al.
7,493,967 B2 2/2009 Mock et al.
7,516,782 B2 4/2009 Sheiretov et al.
7,516,792 B2 4/2009 Lonnes et al.
7,604,060 B2 10/2009 Bloom et al.
7,607,495 B2 10/2009 Bloom et al.
7,607,497 B2 10/2009 Mock et al.
7,624,808 B2 12/2009 Mock
7,743,849 B2 6/2010 Kotsonis et al.
7,748,476 B2 7/2010 Krueger
7,770,667 B2 8/2010 Moore
7,836,950 B2 11/2010 Vail, III et al.
7,854,258 B2 12/2010 Sheiretov et al.
7,900,699 B2 3/2011 Ramos et al.
7,954,562 B2 6/2011 Mock
7,954,563 B2 6/2011 Mock et al.
2001/0045300 A1 11/2001 Fincher et al.
2002/0032126 A1 3/2002 Kusmer
2002/0079107 A1 6/2002 Simpson
2002/0088648 A1 7/2002 Krueger et al.
2003/0024710 A1 2/2003 Post et al.
2003/0150609 A1 8/2003 Stoesz
2003/0183383 A1 10/2003 Guerrero
2005/0034874 A1* 2/2005 Guerrero et al. ..... 166/380
2005/0145415 A1 7/2005 Doering et al.
2005/0217861 A1 10/2005 Misselbrook
2006/0180318 A1 8/2006 Doering et al.
2007/0056745 A1 3/2007 Contant
2007/0095532 A1 5/2007 Head et al.
2007/0181298 A1 8/2007 Sheiretov et al.
2007/0256827 A1 11/2007 Guerrero et al.
2007/0261887 A1 11/2007 Pai et al.
2008/0061647 A1 3/2008 Schmitt
2008/0066963 A1 3/2008 Sheiretov et al.
2008/0073077 A1 3/2008 Tunc et al.
2008/0110635 A1 5/2008 Loretz et al.
2008/0169107 A1 7/2008 Redlinger et al.
2008/0196901 A1 8/2008 Aguirre et al.
2008/0202769 A1 8/2008 Dupree et al.
2008/0223573 A1 9/2008 Nelson et al.
2008/0314639 A1 12/2008 Kotsonis et al.
2009/0008150 A1 1/2009 Lavrut et al.

| | | | | |
|---|---|---|---|---|
| 2009/0025941 | A1 | 1/2009 | Iskander et al. | |
| 2009/0071659 | A1 | 3/2009 | Spencer et al. | |
| 2009/0071660 | A1 | 3/2009 | Martinez et al. | |
| 2009/0091278 | A1 | 4/2009 | Montois et al. | |
| 2009/0159295 | A1 | 6/2009 | Guerrero et al. | |
| 2009/0218105 | A1 | 9/2009 | Hill et al. | |
| 2009/0229820 | A1 | 9/2009 | Saeed | |
| 2009/0236101 | A1 | 9/2009 | Nelson et al. | |
| 2009/0294124 | A1 | 12/2009 | Patel | |
| 2009/0301734 | A1 | 12/2009 | Tunc et al. | |
| 2009/0321141 | A1 | 12/2009 | Kotsonis et al. | |
| 2010/0018695 | A1 | 1/2010 | Bloom et al. | |
| 2010/0038138 | A1 | 2/2010 | Mock et al. | |
| 2010/0108387 | A1 | 5/2010 | Bloom et al. | |
| 2010/0108394 | A1 * | 5/2010 | Ollerenshaw et al. | 175/284 |
| 2010/0263856 | A1 | 10/2010 | Lynde et al. | |
| 2010/0307832 | A1 | 12/2010 | Mock et al. | |

FOREIGN PATENT DOCUMENTS

| | | | |
|---|---|---|---|
| DE | 2920049 | | 2/1987 |
| EP | 0 149 528 | A1 | 7/1985 |
| EP | 0 951 611 | B1 | 1/1993 |
| EP | 0 257 744 | B1 | 1/1995 |
| EP | 0 767 289 | A1 | 4/1997 |
| EP | 0911483 | | 4/1997 |
| EP | 1 281 834 | A | 2/2003 |
| EP | 1 344 893 | A2 | 9/2003 |
| EP | 1370891 | | 11/2006 |
| EP | 1223305 | | 4/2008 |
| GB | 894117 | | 4/1962 |
| GB | 1105701 | | 3/1968 |
| GB | 2 241 723 | A | 9/1991 |
| GB | 2 305 407 | | 4/1997 |
| GB | 2 310 871 | A | 9/1997 |
| GB | 2 346 908 | A | 8/2000 |
| GB | 2401130 | | 11/2004 |
| WO | WO 89/05391 | | 6/1989 |
| WO | WO 92/13226 | | 8/1992 |
| WO | WO 93/18277 | | 9/1993 |
| WO | WO 94/27022 | | 11/1994 |
| WO | WO 95/21987 | | 8/1995 |
| WO | WO 00/36266 | | 6/2000 |
| WO | WO 00/46461 | | 8/2000 |
| WO | WO 00/63606 | | 10/2000 |
| WO | WO 00/73619 | | 12/2000 |
| WO | WO 02/44509 | A2 | 6/2002 |
| WO | WO 2005/057076 | | 6/2005 |
| WO | WO 2007039025 | | 4/2007 |
| WO | WO 2007134748 | | 11/2007 |
| WO | WO 2008/104177 | | 9/2008 |
| WO | WO 2008/104178 | | 9/2008 |
| WO | WO 2008/104179 | | 9/2008 |
| WO | WO 2008/128542 | | 10/2008 |
| WO | WO 2008/128543 | | 10/2008 |
| WO | WO 2009/062718 | | 5/2009 |
| WO | WO 2010/062186 | | 6/2010 |
| WO | WO 2011/005519 | | 1/2011 |

OTHER PUBLICATIONS

PCT International Search Report and Written Opinion of the ISA dated Jun. 16, 2005 for International Application No. PCT/US2005/008919.

PCT International Search Report and Written Opinion of the ISA dated Apr. 22, 2008 for International Application No. PCT/US2007/084574.

"Kilobomac to Challenge Tradition" Norwegian Oil Review, 1988, pp. 50-52.

U.S. Appl. No. 60/201,353, and cover sheet, filed May 2, 2000 entitled "Borehole Retention Device" in 23 pages.

* cited by examiner

METHODS AND APPARATUSES FOR INHIBITING ROTATIONAL MISALIGNMENT OF ASSEMBLIES IN EXPANDABLE WELL TOOLS

CROSS-REFERENCE TO RELATED APPLICATIONS

This application claims the benefit of U.S. Provisional Patent Application No. 61/246,955, entitled "EXPANDABLE RAMP GRIPPER," filed on Sep. 29, 2009, and U.S. Provisional Patent Application No. 61/369,637, entitled "METHODS AND APPARATUSES FOR INHIBITING ROTATIONAL MISALIGNMENT OF ASSEMBLIES IN EXPANDABLE WELL TOOLS," filed on Jul. 30, 2010. Also, this application hereby incorporates by reference both of the above-identified provisional applications in their entireties.

BACKGROUND OF THE DISCLOSURE

1. Field of the Disclosure

This application relates generally to borehole tractors and gripping mechanisms for downhole tools.

2. Description of the Related Art

Tractors for moving within downhole passages are often required to operate in harsh environments and limited space. For example, boreholes for oil drilling typically are approximately 3.5-27.5 inches in diameter.

Western Well Tool, Incorporated has developed a variety of downhole tractors for drilling, completion and intervention processes for wells and boreholes. For example, the Puller-Thruster tractor is a multi-purpose tractor (U.S. Pat. Nos. 6,003,606, 6,286,592, and 6,601,652) that can be used in rotary, coiled tubing and wireline operations. A method of moving is described in U.S. Pat. No. 6,230,813. The Electro-hydraulically Controlled tractor (U.S. Pat. Nos. 6,241,031 and 6,427,786) defines a tractor that utilizes both electrical and hydraulic control methods. The Electrically Sequenced tractor (U.S. Pat. No. 6,347,674) defines a sophisticated electrically controlled tractor. The Intervention tractor (also called the tractor with improved valve system, U.S. Pat. No. 6,679,341 and U.S. Patent Application Publication No. 2004/0168828) is preferably an all hydraulic tractor intended for use with coiled tubing that provides locomotion downhole to deliver heavy loads such as perforation guns and sand washing. All of these patents and patent applications are incorporated herein by reference in their entireties.

These various tractors can provide locomotion to pull or push various types of loads. For each of these various types of tractors, various types of gripper elements have been developed. Thus one important part of the downhole tractor tool is its gripper system.

Tractors may have at least two grippers that alternately actuate and reset to assist the motion of the tractor. In one cycle of operation, the body is thrust longitudinally along a first stroke length while a first gripper is actuated and a second gripper is retracted. During the first stroke length, the second gripper moves along the tractor body in a reset motion. Then, the second gripper is actuated and the first gripper is subsequently retracted. The body is thrust longitudinally along a second stroke length. During the second stroke length, the first gripper moves along the tractor body in a reset motion. The first gripper is then actuated and the second gripper subsequently retracted. The cycle then repeats. Alternatively, a tractor may be equipped with only a single gripper, for example for specialized applications of well intervention, such as movement of sliding sleeves or perforation equipment.

Grippers can be designed to be powered by fluid, such as drilling mud in an open tractor system or hydraulic fluid in a closed tractor system. Typically, a gripper assembly has an actuation fluid chamber that receives pressurized fluid to cause the gripper to move to its actuated position. The gripper assembly may also have a retraction fluid chamber that receives pressurized fluid to cause the gripper to move to its retracted position. Alternatively, the gripper assembly may have a mechanical retraction element, such as a coil spring or leaf spring, which biases the gripper back to its retracted position when the pressurized fluid is discharged. Motor-operated or hydraulically controlled valves in the tractor body can control the delivery of fluid to the various chambers of the gripper assembly.

The original design of the Western Well Tool Puller-Thruster tractor incorporated the use of an inflatable reinforced rubber packer (i.e., "Packerfoot") as a means of anchoring the tool in the well bore. This original gripper concept was improved with various types of reinforcement in U.S. Pat. No. 6,431,291, entitled "Packerfoot Having Reduced Likelihood of Bladder Delamination." This patent is incorporated herein by reference in its entirety. This concept developed a "gripper" with an expansion of the diameter of approximately 1 inch. This design was susceptible to premature failure of the fiber terminations, subsequent delamination and pressure boundary failure.

The second "gripper" concept was the Roller Toe Gripper (U.S. Pat. Nos. 6,464,003 and 6,640,894). These patents are incorporated herein by reference in their entireties. The current embodiment of this gripper works exceedingly well, however in one current embodiment, there are limits to the extent of diametrical expansion, thus limiting the well bore variations compatible with the "gripper" anchoring. Historically, the average diametrical expansion has averaged approximately 2 inches. Several advantages of the RTG compared to the bladder concept were enhanced service life, reliability and "free expansion" capabilities. Free Expansion is a condition when the gripper is completely inflated but does not have a wall to anchor against. This condition is usually only applicable in non-cased or "open-hole" bores. The RTG concept used a ramp and roller combination to radially expand a leaf spring like "toe" to anchor the tractor to the casing. The radial expansion could be fixed with mechanical stops, thereby reducing the risk of overstressing due to free expansion.

U.S. Pat. No. 7,624,808, entitled "Expandable Ramp Gripper," which is hereby incorporated by reference herein in its entirety discloses another Western Well Tool gripper, which can, in some embodiments be highly reliable and durable, and provide a desired expansion force over a wide range of expansion diameters. In some embodiments, the Expandable Ramp Gripper of the '808 patent incorporates the use of a plurality of interconnected links to produce a dual radial force mechanism. Initially, the links can desirably provide a combination of a toggle mechanism and roller/ramp mechanism to produce two sources of radial force. As the centerline of the two links approaches a predetermined deployment angle, such as, for example, approximately 90°, the toggle mechanism no longer contributes and the roller/ramp mechanism provides the sole source of radial force.

SUMMARY OF THE DISCLOSURE

As noted above, boreholes for oil drilling typically are approximately 3.5-27.5 inches in diameter. For safe extraction, expandable assemblies, such as grippers, generally must collapse to a diameter equal to or less than the diameter of the borehole into which it has been inserted. In the event that an expandable mechanism fails to be properly collapsed or retracted, the expandable mechanism, other downhole equipment, the borehole or a combination of any of these may be damaged.

In some systems, rotation of an expandable assembly relative to other equipment, such as an wellbore engagement assembly, about a length of a gripper assembly could potentially inhibit or prevent the expandable assembly from being fully collapsed, resulting in the collapsed outer diameter being significantly larger than intended and potentially greater than would permit safe extraction. Thus, it may be desirable in some instances to inhibit or to prevent an expandable assembly from rotating relative to driving or other assemblies of a tractor or other downhole equipment. In some embodiments, the systems and methods of the present application can reduce or eliminate the possibility that an expandable assembly, such as a gripper, fail to adequately collapse or retract within a passage.

In one embodiment, a gripper assembly comprises an elongate member, an expandable assembly, and an engagement assembly. The elongate member has a length. The expandable assembly is connected to the elongate member for movement between an expanded configuration and a collapsed configuration. The engagement assembly is positioned generally over the expandable assembly such that expansion of the expandable assembly urges at least a portion of the engagement assembly away from the elongate member. The engagement assembly is connected to the expandable assembly such that rotation of the engagement assembly about the length of the elongate member relative to the expandable assembly is restricted to less than approximately 15° without plastic deformation of at least one of the engagement assembly, the expandable assembly, and the elongate member.

In some embodiments, rotation of the engagement assembly about the length of the elongate member relative to the expandable assembly can be restricted to less than approximately 10° without plastic deformation of at least one of the engagement assembly the expandable assembly, and the elongate member. In some embodiments, rotation of the engagement assembly about the length of the elongate member relative to the expandable assembly can be restricted to less than approximately 5° without plastic deformation of at least one of the engagement assembly the expandable assembly, and the elongate member.

These and other embodiments will become readily apparent to those skilled in the art from the following detailed description of the preferred embodiments having reference to the attached figures, the invention not being limited to any particular preferred embodiment(s) disclosed.

DETAILED DESCRIPTION OF EXEMPLIFYING EMBODIMENTS

Some embodiments of methods and apparatuses for managing rotational alignment of assemblies of expandable well tools are described in the context of certain gripper assemblies. Nevertheless, the methods and apparatuses disclosed herein can be advantageously incorporated into other gripper assemblies and other types of expandable assemblies for downhole operation.

An Expandable Ramp Gripper or ERG is illustrated in FIGS. 1-9. The ERG can be configured to function by means of an expandable assembly applying a radial expansion force to an overlying engagement assembly to expand the engagement assembly. Details regarding the ERG, further to those provided herein, are provided in U.S. Pat. No. 7,624,808, entitled "Expandable Ramp Gripper," which is hereby incorporated by reference herein in its entirety. The ERG can be positioned in a passage and operated in either axial orientation with respect to the uphole and downhole directions of a particular passage. However, as further discussed below with respect to the Figures herein, it can be desirable to orient the ERG such that the mandrel cap 138 (FIG. 1) is at the downhole end of the ERG and the cylinder cap 106 (FIG. 1) is at the uphole end. Thus, the discussion herein assumes the ERG is positioned in a passage such that the mandrel cap 106 is at the downhole end of the ERG.

Figure 1:
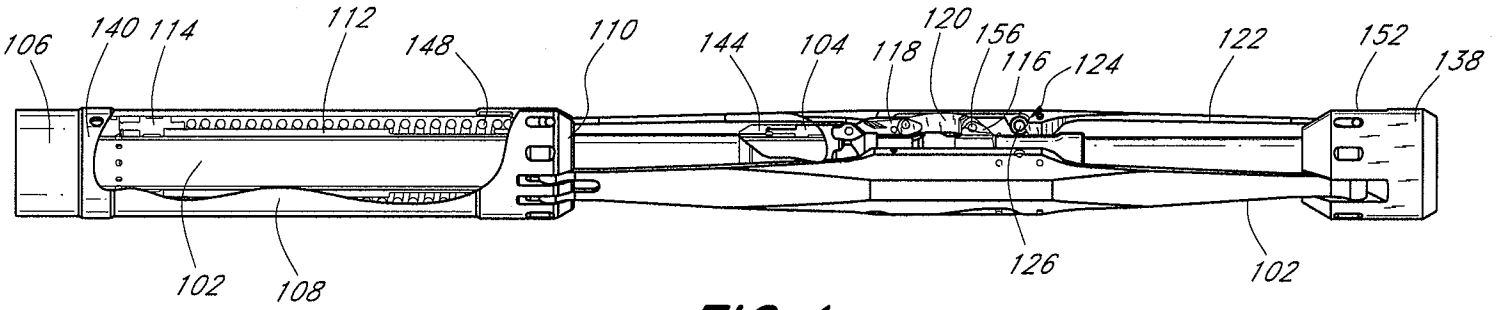
FIG. 1 is a cut away side view of one embodiment of gripper assembly.

As illustrated in FIG. 1, the gripper comprises an actuator and a gripper assembly. The actuator is described in more detail in FIG. 2. In the illustrated embodiments, the actuator comprises a spring returned, single acting hydraulic piston-cylinder assembly. In other embodiments, other mechanical, hydraulic, or electric actuators can be coupled to the gripper assembly mechanism to expand and retract the gripper. The radial force generated by the expandable assembly deflects the engagement assembly outward until either the wellbore or casing is engaged or the radial deflection ceases due to mechanical stops. As with previous grippers, the ERG may allow axial translation of a tractor shaft while the gripper is engaged.

The ERG gripper can be broken down into several sub assemblies for ease of description. For example, as discussed herein, the ERG is categorized into cylinder assembly, expandable assembly, and engagement assembly. While each ERG gripper subassembly is described herein with respect to the illustrated embodiments as comprising various structural components, it is contemplated that in alternate embodiments, the structural components could form part of other sub assemblies.

Actuator or Cylinder Assembly

As noted above, FIG. 2 illustrates an actuator or cylinder assembly for generating axial force to selectively expand and retract the ERG gripper. In the illustrated embodiment, the cylinder assembly is a hydraulic spring returned single-action piston and cylinder actuator comprising a cylinder cap 106, cylinder 108, engagement assembly support 110, piston 114, piston rod 112, spring 148, spring guide 146, mandrel 102, wear ring 140, and associated seals and wear guides. The mandrel 102 can provide a fluid channel from ports in the shaft to the piston area of the cylinder assembly independent of the axial position of the ERG relative to the shaft ports. Therefore, the actuator can be supplied with pressurized hydraulic fluid to generate force while the actuator is axially slid with respect to the downhole tool. When an ERG is integrated into a downhole tractor assembly, the mandrel 102 can also form an integral part of the main load path on the aft shaft assemblies.

Figure 2:
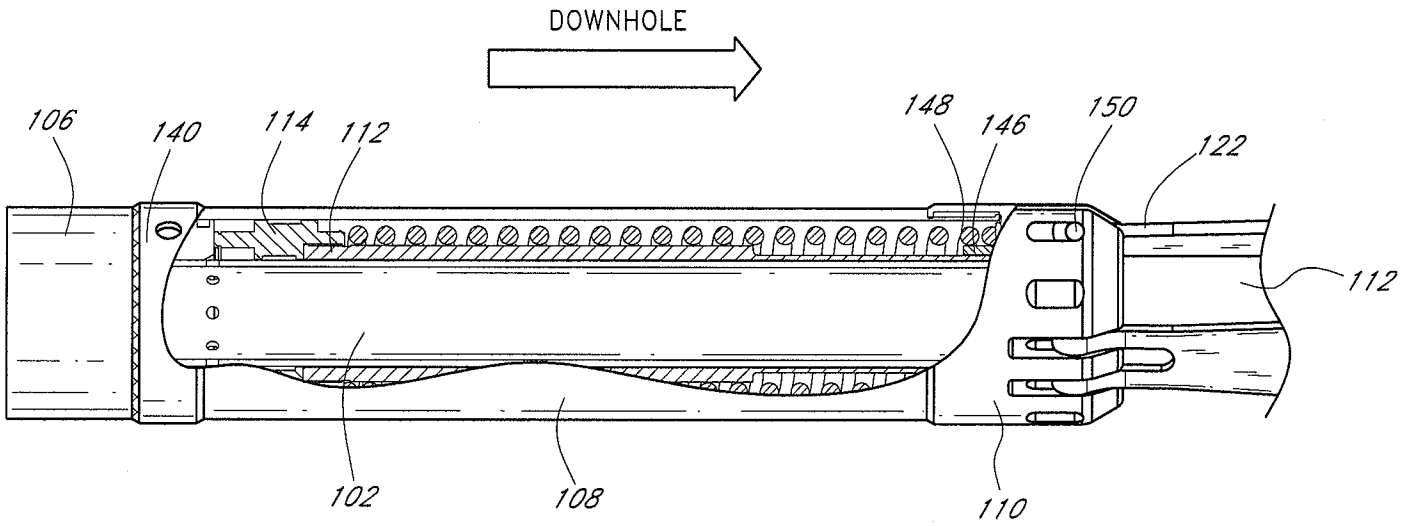
FIG. 2 is a cut away side view of an actuator of the gripper assembly of FIG. 1.

With reference to FIG. 2, the cylinder cap 106, cylinder 108 and engagement assembly support 110 define a structural cylinder housing of the cylinder assembly. The cylinder cap 106 and engagement assembly support 110 can be attached to the cylinder 108 in a multitude of ways including outside diameter (OD) threads, inside diameter (ID) threads, pins, or any combination thereof. The cylinder cap 106 can desirably provide a seal between the piston area and annulus. In certain embodiments, the cylinder cap 106 can also rigidly connect the ERG to the shaft cylinder assembly to form a portion of the tractor.

In the embodiment illustrated in FIG. 1, the engagement assembly support 110 acts as an attachment point for engagement assemblies (and functions as the cap on the spring side of the cylinder assembly). As illustrated in FIG. 2, the engagement assembly support 110 in combination with the spring guide 146 can provide a mechanical stop for the piston 114 and piston rod 112 to prevent over travel. In other embodiments, other mechanical stops can be provided to limit travel of the piston 114 and piston rod 112.

As illustrated in FIG. 2, the piston 114 desirably includes both inner diameter and outer diameter seals to prevent hydraulic fluid from escaping between the piston and the mandrel 102 (on the inner side) and between the piston 114 and the cylinder 108 (on the outer side). The piston 114 is desirably firmly attached to the piston rod 112 such that movement of the piston 114 moves the piston rod 112 a like amount. The piston 114 axially translates between the mandrel 102 and cylinder 108 on the inner diameter and outer diameter, respectively. In the illustrated embodiment, the piston 114 travels in the downhole direction (in the direction of the arrow in FIG. 2) during ERG expansion. In some embodiments, movement of the piston 114 (and, thus, activation of the gripper) can be controlled by activation from fluid pressure from a tractor control assembly. When hydraulic fluid the piston area is vented to annulus (outside the tractor), the piston 114 can be returned to the uphole position, by the spring 148, thereby allowing the gripper to retract.

Engagement Assembly

Figure 3:
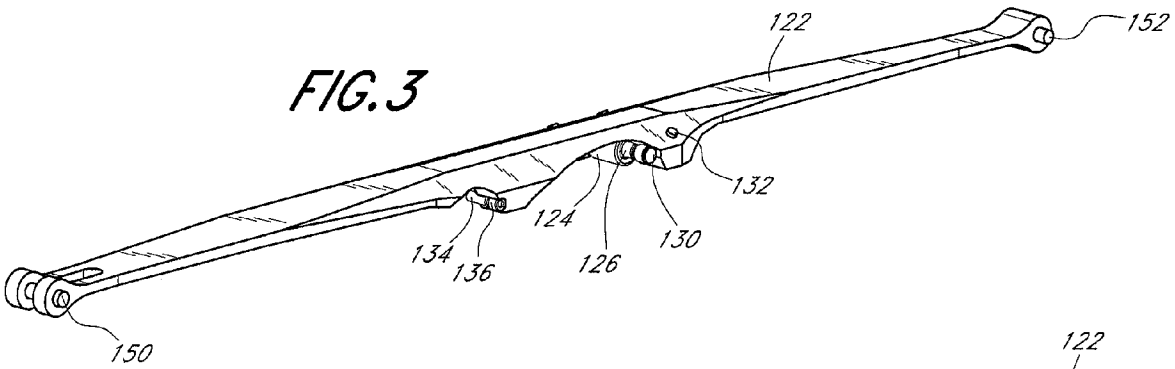
FIG. 3 is a cut away perspective view of a engagement assembly of the gripper assembly of FIG. 1.
Figure 3A:
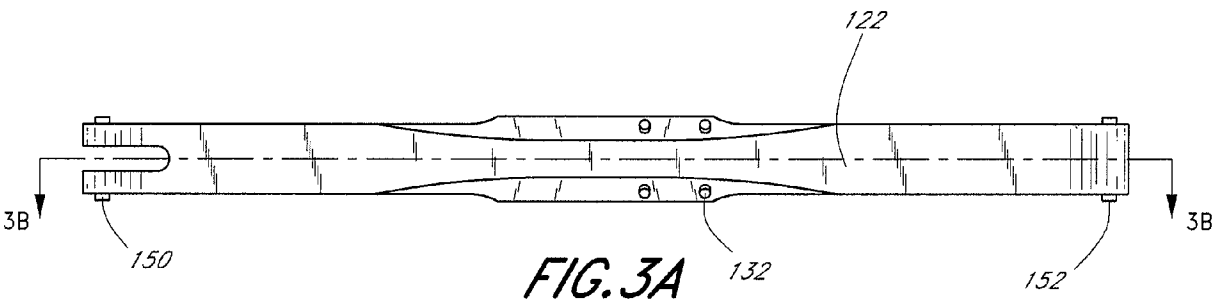
FIG. 3A is a top view of the engagement assembly of FIG. 3.
Figure 3B:
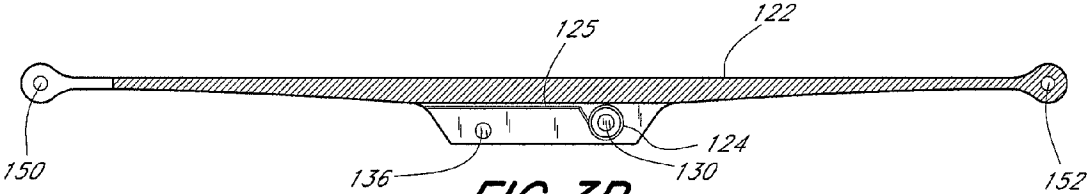
FIG. 3B is a cut away side view of the engagement assembly of FIG. 3 taken along line 3B-3B.

With reference to FIG. 1, the gripper assembly desirably includes three toe or engagement assemblies substantially equally angularly placed around the mandrel 102. Advantageously, a gripper assembly having three engagement assemblies can apply radial expansion force to grip a passage having a non-uniform, or out-of-round geometry. In other embodiments, the gripper assembly can include more or fewer engagement assemblies. As illustrated in FIGS. 3, 3A, and 3B, a engagement assembly generally comprises an engagement portion or engagement assembly 122 and an expandable assembly interaction mechanism. The engagement assembly 122 can comprise a first end configured to be coupled to engagement assembly support 110 (FIG. 1) with one or more pins 150, a second end configured to be coupled to the mandrel cap 138 with one or more pins 152, and a central area between the first and second ends in which the expandable assembly interaction mechanism is positioned.

As illustrated in FIG. 1, the first and second ends of the engagement assembly 122 can be coupled to the gripper assembly in pin-to-slot connections such that the ends of the engagement assembly 122 can translate axially with respect to the mandrel cap 138 and engagement assembly support 110 to allow the central area of the engagement assembly 122 to be radially expanded with respect to the mandrel 102. In a collapsed configuration, the engagement assembly 122 can axially move in the slots of the mandrel. This movement allows the engagement assembly 122 to shift until one of the engagement assembly eyes takes all exterior loading in tension. In the expanded condition, the slots allow for axial shortening of the engagement assembly 122 during deflection of the central area. However, with the illustrated pin-to-slot connection, the first and second ends of the engagement assembly 122 are substantially radially fixed with respect to the mandrel 102. In other embodiments, different connections can be used to couple the engagement assembly 122 to the gripper assembly. For example, in one embodiment, one end of the engagement assembly 122 can be coupled in a pin-to-socket type connection such that its movement is restrained both radially and axially, while the other end of the engagement assembly 122 can be coupled in a pin-to-slot type connection as illustrated.

FIGS. 3 and 3B illustrate cut away views of the engagement assembly 122 with portions removed to illustrate the expandable assembly interaction mechanism in the central area. In the embodiment illustrated in FIGS. 3, 3A, and 3B, the expandable assembly interaction mechanism comprises a roller 124 rotatably mounted to the engagement assembly 122 on an axle 126. The axle 126 can pass through an axis of rotation of the roller 124 and couple the roller 124 in a recess or slot on an inner surface of the central area of the engagement assembly 122. The roller 124 can be positioned such that it interfaces with the expandable assembly to radially expand the central area of the engagement assembly 122 with respect to the mandrel 102. While a roller as illustrated herein can be a relatively efficient mechanism to transfer expansion forces from the expandable assembly to the engagement assembly 122, in other embodiments, the expandable assembly interaction mechanism can comprise other mechanisms such as multiple rollers or a relatively low friction skid plate. As further discussed below, the engagement assembly 122 can also include a buckling mechanism such as the illustrated buckling pin 134, also positioned in a recess 136 or slot on an inner surface of the central area of the engagement assembly 122.

With reference to FIG. 3A, the radially outer surface of the central area of the engagement assembly 122 can include gripping elements 132. The gripping elements 132 can comprise metallic inserts configured to grip a passage, such as by surface roughening or texturing to present a relatively high friction outer surface to provide a positive lock between the engagement assembly and casing/formation to effectively transfer load. The gripping elements 132 can desirably be pressed into the outside of the engagement assembly 122.

Alternatively, the gripping elements 132 can be connected to the engagement assembly 122 by welding, adhering, or securing with fasteners.

Expandable Assembly

Figure 4:
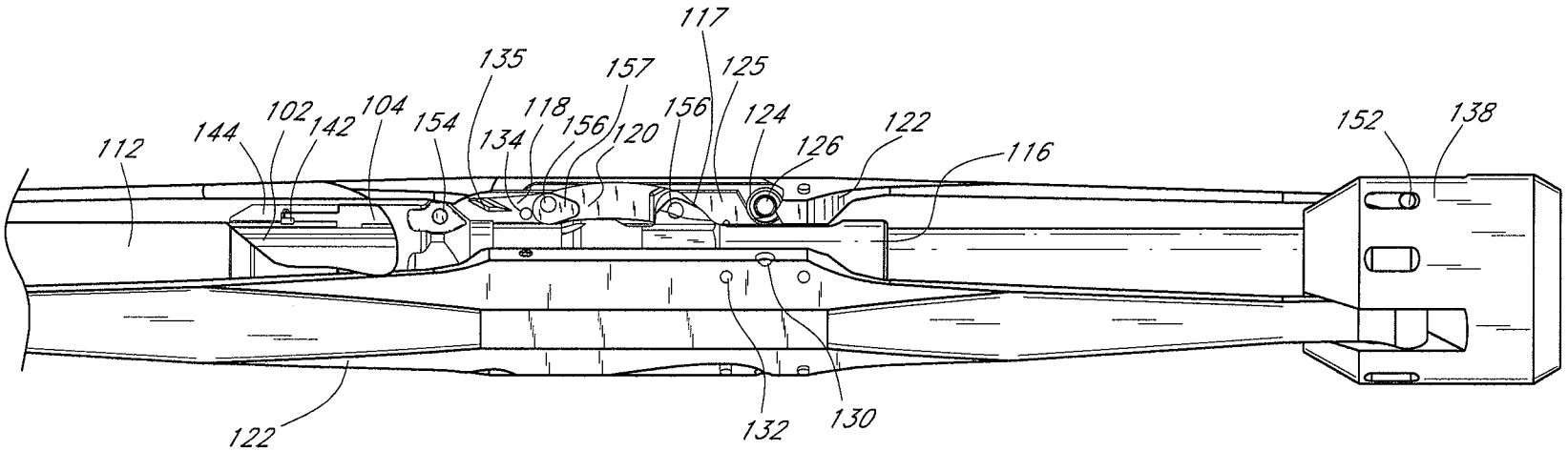
FIG. 4 is a cut away side view of the expandable assembly of the gripper assembly of FIG. 1.

With reference to FIGS. 4-9 an expandable assembly is illustrated underlying the engagement assembly. In the illustrated embodiment, the expandable assembly comprises a linkage assembly having a plurality of member segment links 118, 120 connected serially end to end. The member segment links 118, 120 of the expandable assembly are moveable between a retracted position in which a longitudinal axis of the link assembly is substantially parallel with the elongated shaft and an expanded position in which the link assembly is buckled radially outward with respect to the elongated shaft. Desirably, the expandable assembly comprises two segments pivotally connected to each other end-to-end. As depicted in FIG. 4, the expandable assembly comprises a first link 118 and a second link 120. In the illustrated embodiment, the first link 118 is rotatably coupled to the second link 120 with a pin 156. In the illustrated embodiment, the first link 118 is relatively short in an axial direction relative to the second link 120. Advantageously, this linkage geometry contributes to the ERG expansion cycle properties of high force exertion over a relatively large expansion range of the gripper assembly. However, in other embodiments, the relative axial lengths of the links 118, 120 can be varied to achieve other desired expansion characteristics.

With reference to FIGS. 1 and 4, the expandable assembly is operatively coupled to the cylinder assembly to facilitate the transfer of axial motion generated by the cylinder assembly into radial expansion of the engagement assembly. As illustrated, an end of the first link 118 is rotatably coupled to an operating sleeve 104 with a pin 154 such as a tight fit pin. This pinned connection axially positions the first link 118 relative to the engagement assembly when the ERG is in a collapsed position. The operating sleeve 104 is coupled to a protruding end of the piston rod 112. As noted above, the first link 118 can be pinned to the second link 120 with a pin 156 near one end of the second link 120. The opposite end of the second link 120 can be pinned to a sliding sleeve 116, which can axially translate relative to the mandrel 102 (FIG. 1). In the illustrated embodiments, pins 154, 156 form pinned connections in the expandable assembly to tightly control the position of and the motion of the expandable assembly. However, in other embodiments, other connections, such as other rotatable connections, could be used to interconnect the expandable assembly.

Various materials can be chosen for the expandable assembly to meet desired strength and longevity requirements. Certain materials used in the links 118, 120, and the pins 154, 156 can result in premature galling and wear of the links 118, 120, and a reduced assembly longevity. Undesirably, galling of the links 118, 120, can result in increased retention of debris by the expandable assembly and, in some instances, difficulty in retracting the gripper, and difficulty removing the gripper from a passage. In one embodiment, the links 118, 120 of the expandable assembly are comprised of inconel. In some embodiments, the pins 154, 156 can be comprised of copper beryllium. More preferably, the pins 154, 156 can be comprised of tungsten carbide (with cobalt or nickel binder) to provide an increased operational fatigue life and reduced tendency to gall the links 118, 120.

Figure 5:
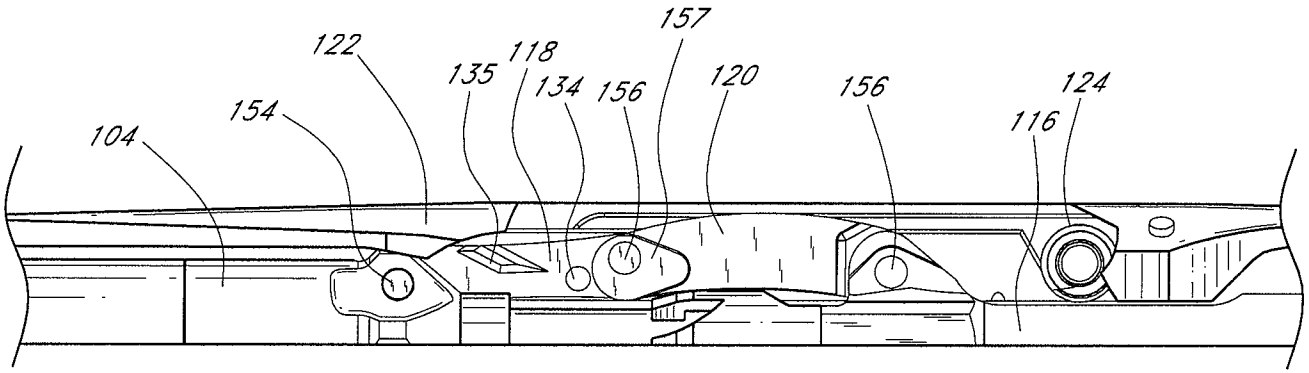
FIG. 5 is a cut away side view of the gripper assembly of FIG. 1 in a collapsed position.

As illustrated in FIGS. 4-5, in a collapsed configuration of the ERG, the expandable assembly underlies the engagement assembly such that the roller 124 of the engagement assembly is on the downhole side of a ramp 117 formed on the sliding sleeve 116 at the pinned connection of the second link 120 to the sliding sleeve 116. As noted above, the ramp 117 on the sliding sleeve 116 can be said to be a "fixed ramp" as an inclination angle defining the ramp 117 remains constant throughout an expansion cycle of the ERG.

In the illustrated embodiment, substantially the entire expandable assembly underlies the recess in the radially inner side of the central area of the engagement assembly 122 in which the roller 124 is positioned. Thus, advantageously, an ERG gripper assembly can be configured such that the expandable assembly and engagement assembly comprise a relatively small axial length in comparison to existing gripper assemblies. Thus, when incorporated in a tractor with a given axial length, the ERG can have a relatively long propulsion cylinder assembly allowing for a relatively long piston stroke for axial movement of the tractor. This relatively long piston stroke can facilitate rapid movement of the ERG as fewer piston cycles will be necessary to traverse a given distance.

Inhibition of Rotational Misalignment

FIGS. 4-9 illustrate the engagement assembly 122 overlying the expandable assembly comprising the first link 118 and the second link 120. In the event that the engagement assembly 122, the expandable assembly, or both are rotated about the longitudinal axis of the gripper assembly such that the engagement assembly 122 no longer overlies the expandable assembly, then the engagement assembly 122, the expandable assembly, or both may be unable to move to a fully collapsed state. Such rotational misalignment of the engagement assembly 122 and expandable assembly may, in some instances, result in damage to the gripper assembly, the wellbore, associated equipment or a combination thereof during extraction of the gripper assembly from a well. Thus, it is desirable to inhibit the engagement assembly and expandable assembly from rotating about a length of the gripper assembly relative to each other.

The engagement assembly and expandable assembly are preferably prevented, or at least inhibited, from rotating about a length of the gripper assembly relative to each other such that rotation of the engagement assembly about the length of the elongate member relative to the expandable assembly to less than approximately 15°, more preferably to less than approximately 10°, and yet more preferably to less than approximately 5° without plastic deformation of at least one of the engagement assembly, the engagement assembly, elongate member.

As illustrated in FIGS. 3, 3A, 3B, and 5-9, the engagement assembly 122 can comprise a groove or track 125. The groove 125 can be located in a central area of the engagement assembly 122 as shown in the illustrated embodiment. The expandable assembly can be configured such that a boss 157 (FIG. 5-9) on the second link 120 near the rotatable joint near the first and second links 118, 120 extends into the groove 125. The boss 157 can transmit force to the engagement assembly 122 at the groove 125, including rotational forces, such as, for example, about a longitudinal axis of the actuator or cylinder assembly of the illustrated embodiment. This or similar interaction of the expandable assembly and the engagement assembly can advantageously inhibit or prevent misalignment of the expandable assembly relative to the engagement assembly.

In some preferred embodiments, the expandable assembly, or at least a portion thereof such as the boss 157 for example, fits snuggly into the groove 125 when the expandable assembly is in the collapsed or retracted position, as illustrated for example in FIG. 5. Engagement of the expandable assembly with the engagement assembly preferably maintains or substantially maintains rotational alignment of these assemblies when the expandable assembly is at least partially expanded.

In some preferred embodiments, engagement of the expandable assembly with the engagement assembly maintains or substantially maintains rotational alignment of these assemblies when the expandable assembly is fully expanded.

The groove or track 125 can be machined, cast, forged or otherwise formed by one or more operations into the engagement assembly 122.

Given the potential ramifications of rotational misalignment of the expandable assembly with the engagement assembly, the provision of redundant systems can advantageously reduce the likelihood of the engagement assembly and the expandable assembly from rotating about a length of the gripper assembly relative to each other even under large external forces, and in some preferred embodiments can absolutely prevent rotational misalignment of these structures. For example, the engagement assembly and expandable assembly can be prevented from rotating about a length of the gripper assembly relative to each other by more than 5° under a first load, by more than 10° under a second load that is greater then the first load, and by more than 15° under a third load that is greater than the second load.

In embodiments in which the interaction of the expandable assembly with the groove or track 125 of the engagement assembly 122 is used with a second system to limit or inhibit movement of the expandable assembly and the engagement assembly relative to each other, the second system may permit the expandable assembly to move within the groove or track 125, but preferably at least inhibits or prevents the expandable assembly from moving laterally beyond sides of the groove or track 125.

In addition or alternative to the interaction between the boss 157 and the groove 125, the engagement assembly and the expandable assembly can be inhibited or prevented from rotating relative to each other about a length of the gripper assembly by rotational interlocking members. For example, a engagement assembly support 110 and the piston rod 112 can be coupled together by male and female rotational interlocking members. In some embodiments, one of the engagement assembly support 110 and the piston rod 112 can comprise a male rotational interlocking member and the other can comprise a female interlocking member. Likewise, the operating sleeve 104 and the piston rod 112 can be coupled together by male and female rotational interlocking members.

Figure 10:
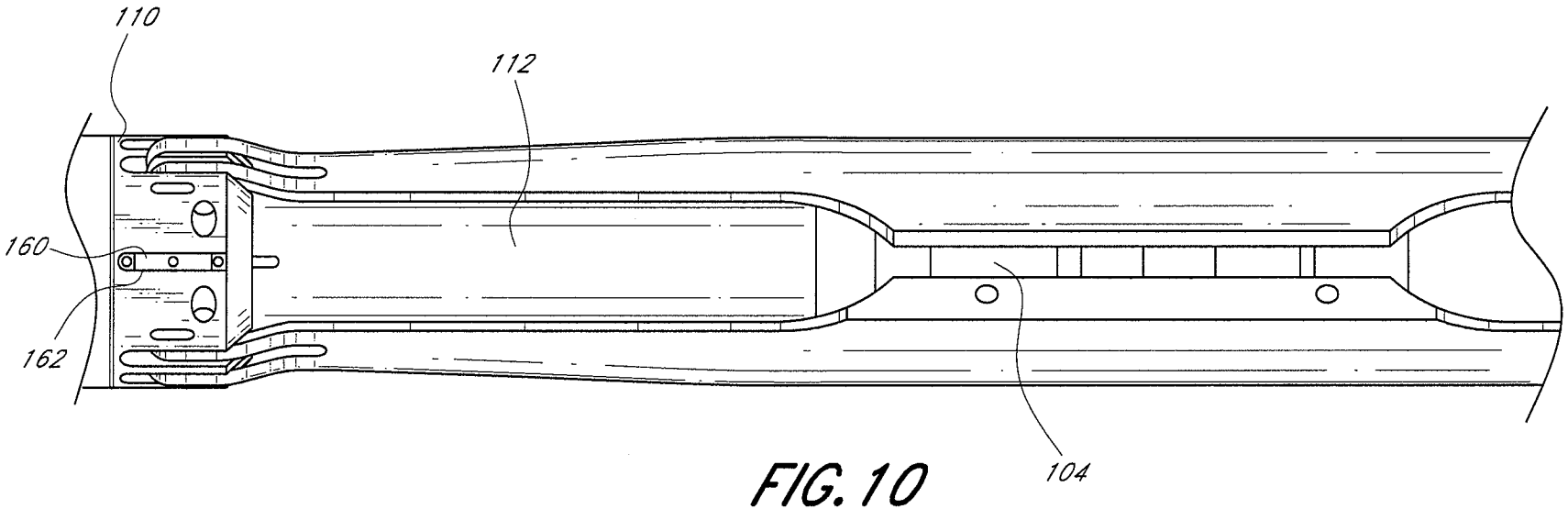
FIG. 10 is a plan view of an embodiment of a gripper assembly.
Figure 11:
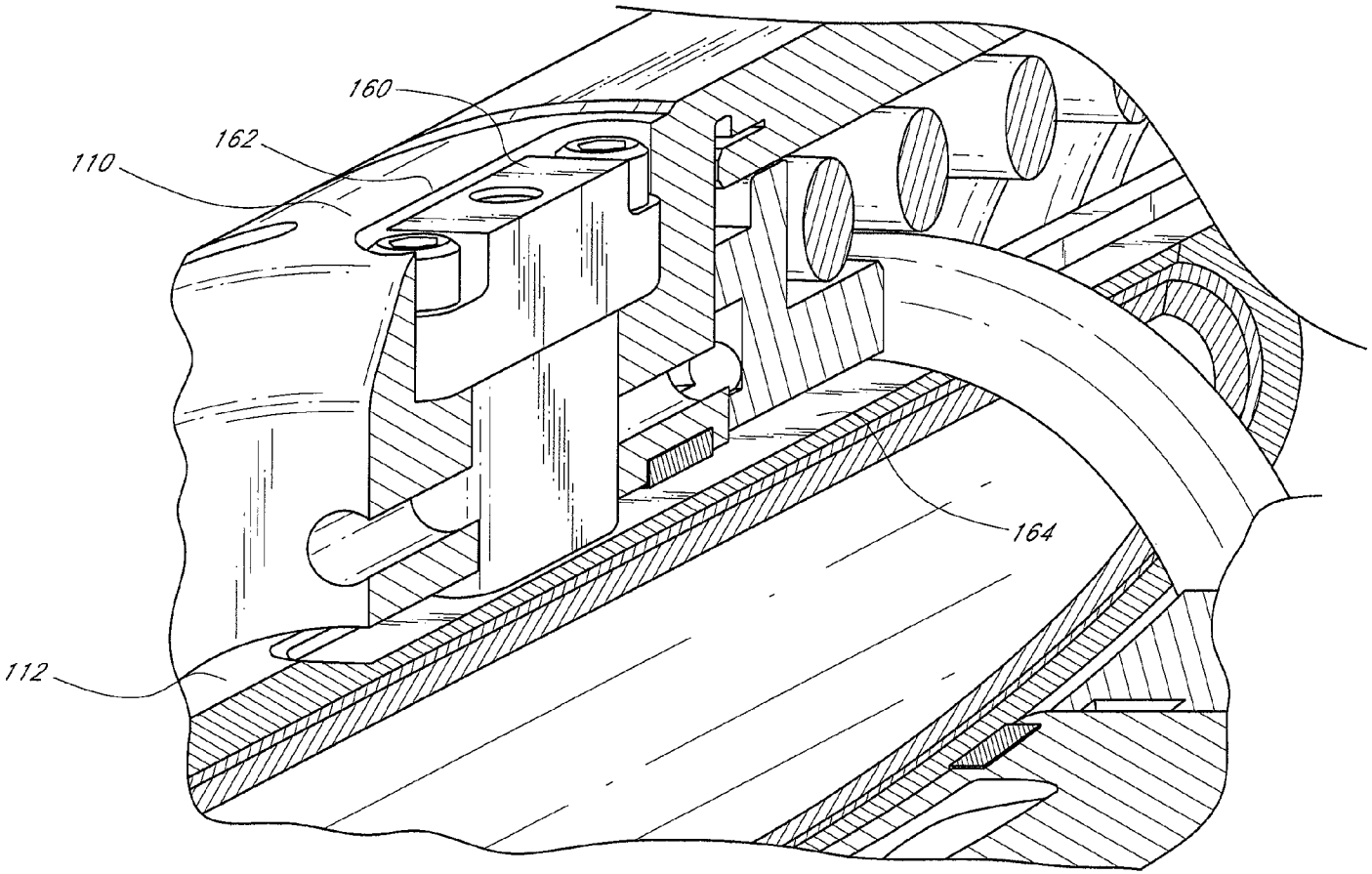
FIG. 11 is an enlarged perspective cross-sectional view of a portion of the gripper assembly of FIG. 10.
Figure 12:
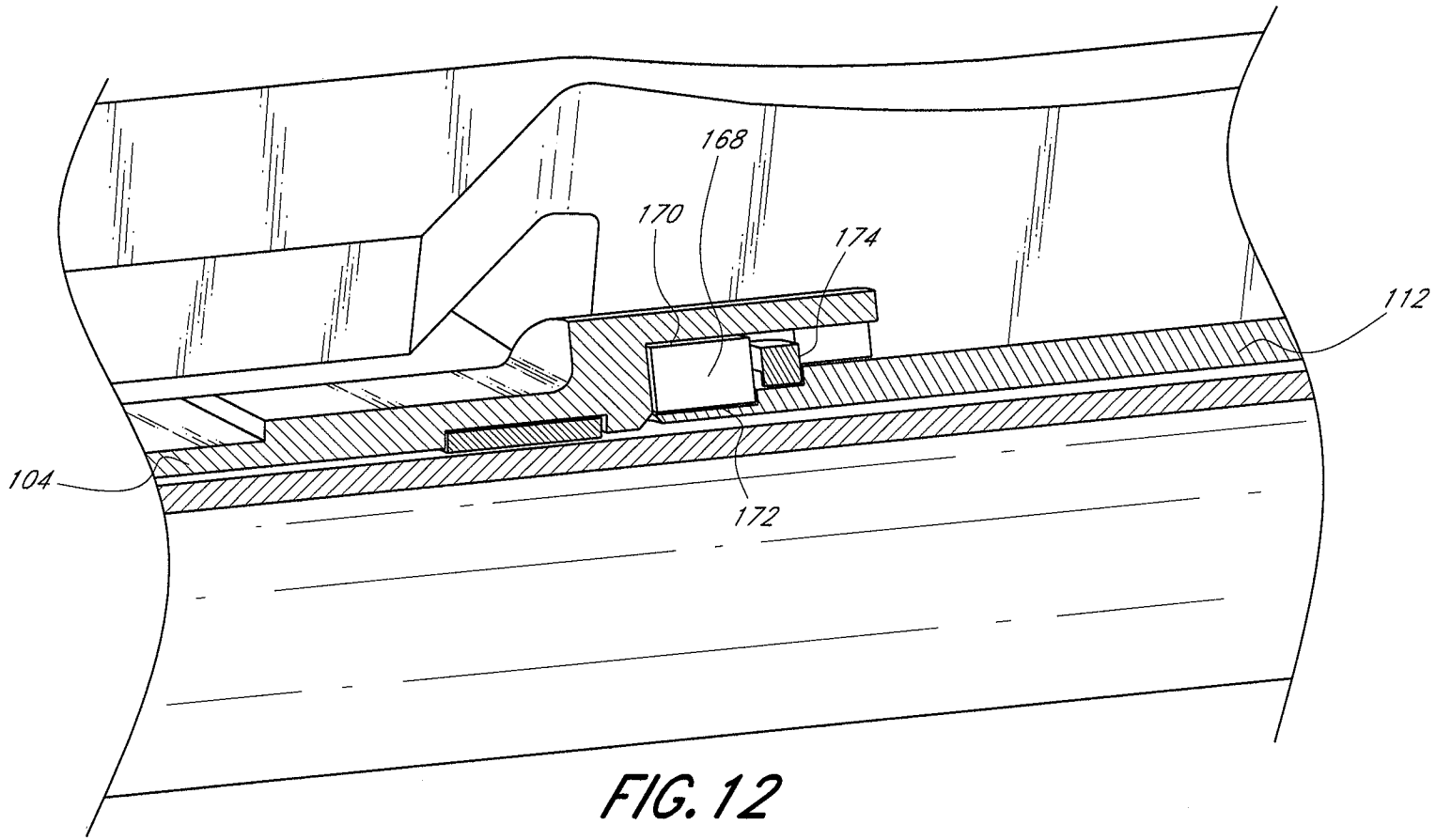
FIG. 12 is an enlarged perspective cross-sectional view of a portion of the gripper assembly of FIG. 10.

FIGS. 10-12 illustrate a system and method for inhibiting or preventing rotational misalignment of the expandable assembly relative to the engagement assembly. In addition or alternative to the interaction of the expandable assembly with the groove or track 125 of the engagement assembly 122, the engagement assembly support 110 and the operating sleeve 104 can be substantially rotationally fixed relative to the piston rod 112, for example as illustrated in FIGS. 10-12. In some embodiments, one or more keys can be specially sized and shaped to fit into adjacent, and possibly matching, openings or recesses of the engagement assembly and the expandable assembly to inhibit or substantially prevent relative rotation between them, thereby advantageously increasing the reliability of fully collapsing the mechanism and increasing the reliability to pass various down hole restrictions and exit the well successfully. The one or more keys advantageously transfer torque applied to one of the engagement assembly and the expandable assembly to the other. The one or more keys can comprise pins, bolts, wedges, or other piece inserted in a hole, recess, or space to lock or hold the engagement assembly and the expandable assembly together.

In some embodiments, both the expandable assembly and the engagement assembly can be inhibited or prevented from rotating about the actuator or cylinder assembly, thereby inhibiting or preventing rotational misalignment of the expandable assembly relative to the engagement assembly. For example, in some embodiments, one or more keys can align the piston rod 112 with the engagement assembly via the engagement assembly support 110 and lock or substantially lock the orientation of the expandable assembly relative to the piston rod 112 to maintain alignment of the engagement assembly with the expandable assembly.

As shown in the embodiment of FIGS. 10 and 11, a key 160 can extend into both an opening 162 in the engagement assembly support 110 and a slot 164 in the piston rod 112. A radial height of the key 160 can be sufficiently great to permit the key 160 to extend simultaneously into both the opening 162 and the slot 164. The key is preferably positioned simultaneously at least partially within the aperture 162 of the engagement assembly support 110 and at least partially in the slot 164 of the piston rod 112.

In some preferred embodiments, such as the illustrated embodiment, the key can have a length and a width that are unequal. For example, the length of the key can be about 2 to about 7 times the wide of the key. In a preferred embodiment the length of the key is about 5 times the width of the key. The length of the key is preferably the dimension of the key substantially along the longitudinal axis of the piston rod in an assembled configuration, whereas the width of the key is preferably the dimension of the key substantially transverse the longitudinal axis and generally tangential to a circumference of the piston rod. Preferably, the opening 162 and the slot 164 are sized and shaped to correspond to the size and shape of the key 160 to limit movement of the engagement assembly support 110 relative to the piston rod 112.

The degree to which the key 160 is permitted to move within the opening 162 influences the extent to which movement of the engagement assembly support 110 is limited relative to the piston rod 112. Thus, the size of the opening 162 in the engagement assembly support 110 preferably closely conforms to the length and width of the key 160. In some embodiments, the key 160 can have a slight interference fit with the opening 162. In other embodiments, the key and opening can have approximately the same shape and dimensions. In yet other embodiments, the key can be slightly smaller than the opening. In some preferred embodiments, the shape of the key and the opening closely conform to each other.

Additionally or alternatively, the key 160 can be fixed in the aperture 162 such that the key cannot move significantly within the aperture 162 under expected load conditions. For example, as illustrated in FIGS. 10 and 11, the key can be attached to the engagement assembly support 110 by one or more screws or bolts 166. In the embodiment illustrated in FIGS. 10 and 11, two screws fix the key 160 in the opening 162 of the engagement assembly support 110.

The degree to which the key 160 is able to move within the slot 164 also influences the extent to which movement of the engagement assembly support 110 is limited relative to the piston rod 112. Thus, the slot 164 of the piston rod 112 preferably has a width that complements the width of the key 160, and in some embodiments closely conforms to the width of the key. The slot 164 preferably has a length substantially greater than the length of the key 160, for example as illustrated in FIG. 11, such that the key 160 can travel, e.g. by sliding, within the slot 164 in a direction generally along the longitudinal axis of the piston rod 112. The slot 164 preferably has clearance with the key under normal operating conditions to facilitate travel of the key within the slot.

In some alternative embodiments, the engagement assembly support 110 can comprise a slot while the piston rod 112 comprises an opening and a key can extend at least partially into the slot and at least partially into the opening to permit longitudinal relative movement of the engagement assembly support and piston rod while inhibiting relative rotation movement between them.

As illustrated in FIG. 12, a key 168 can align the operating sleeve 104 with the piston rod 112. The key 168 is positioned simultaneously at least partially within an aperture 170 of the operating sleeve 104 and an aperture 172 of the piston rod 112. The key 168 preferably inhibits or substantially prevents sliding movement of the operating sleeve 104 relative to the piston rod 112.

The degree to which the key 168 is able to move within the apertures 170, 172 influences the extent to which movement of the operating sleeve 104 is limited relative to the piston rod 112. In preferred embodiments, the apertures 170, 172 closely conform to the size of the key 168. In some such embodiments, the apertures 170, 172 can also have a shape that closely conforms to the shape of the key 168. The key 168 and the apertures 170, 172 can have a slight interference fit in some embodiments.

In embodiments that comprise both interaction of the expandable assembly, e.g. the boss 157 with the engagement assembly, e.g. the groove 125, and the above-described keyed attachment, the keyed attachment can, in some embodiments, inhibit or prevent the expandable assembly from rotating out of engagement with the engagement assembly due under the influence of external forces.

In the illustrated embodiment, the extent to which the expandable assembly is permitted to move relative to the engagement assembly about the length of the gripper assembly is affected by the degree to which the expandable assembly and the engagement assembly are each permitted to move relative to the piston rod. Thus, movement of both the expandable assembly and the engagement assembly relative to the piston rod is inhibited or, preferably, prevented.

Operation Description

FIGS. 5-9 illustrate an expansion cycle of the ERG. In FIGS. 5-9 the central area of the engagement assembly 122 has been partially cut away to illustrate the interface between a radially inner surface of the engagement assembly 122 and the underlying expandable assembly. With reference to FIG. 5, the ERG expansion operation cycle may commence with the ERG in a collapsed position. This collapsed position may be the "as assembled" condition. In the collapsed position, the central area of the engagement assembly 122 can have substantially no deflection. The roller 124 is desirably positioned downhole of the ramp 117 of the sliding sleeve 116 and does not contact either the sliding sleeve 116 or the second link 120.

First Expansion Stage

Figure 6:
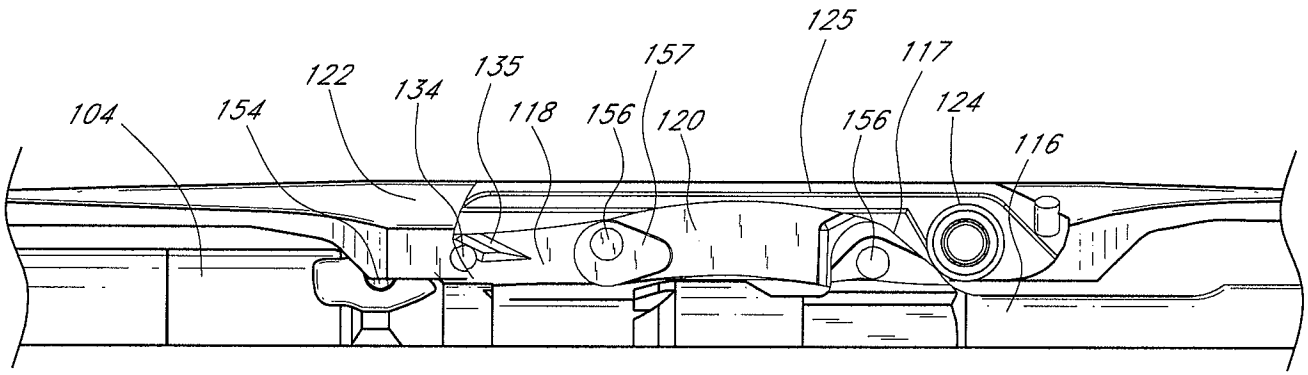
FIG. 6 is a cut away side view of the expandable assembly of the gripper assembly of FIG. 1 in a first stage of expansion.

In FIG. 6, a first stage of expansion is illustrated. In the illustrated embodiment, in the first stage of expansion, axial force generated by the cylinder assembly is transferred to radial expansion force by the interface of the roller 124 on the ramp of the sliding sleeve 116 to initiate expansion of the engagement assembly 122. As the piston 114 and piston rod 112 are moved axially downhole, the operating sleeve 104 can axially move the links 118, 120 and sliding sleeve 116 in a downhole direction towards the mandrel cap 138.

During this first expansion stage, the ramp of the sliding sleeve 116 makes contact with the roller 124 on the engagement assembly 122, such that the interface of the roller mechanism with the ramp can produce forces with radial and axial components. The produced radial force can drive the central area of the engagement assembly 122 radially outward. The produced axial component can react directly against the axial force produced by the piston 114 of the cylinder assembly (FIG. 2) and can cause the expandable assembly to buckle at the rotatable joint coupling the first link 118 and the second link 120.

Figure 7:
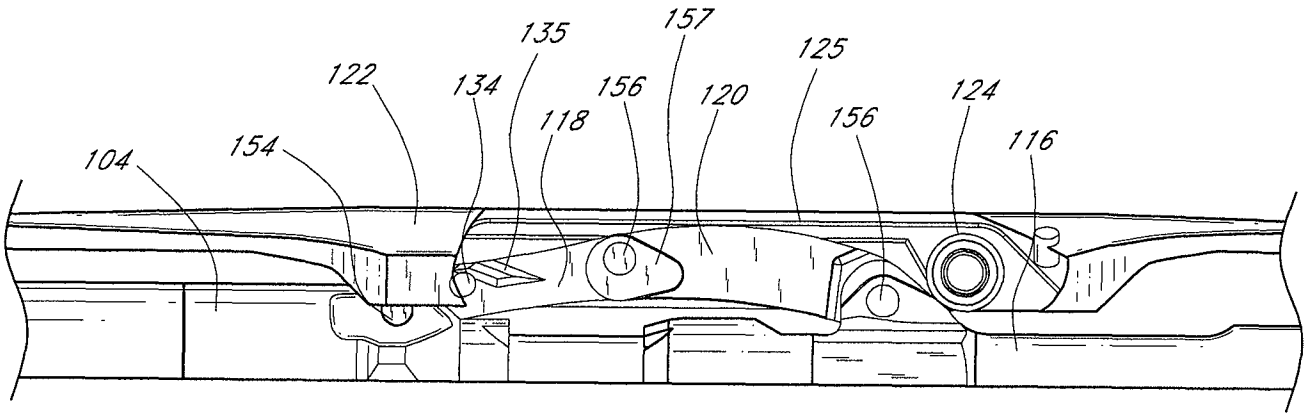
FIG. 7 is a cut away side view of the expandable assembly of the gripper assembly of FIG. 1 in a first stage of expansion with a buckling pin in contact with a directing surface.

With reference to FIG. 7, in some embodiments, the ERG can include a buckling mechanism to facilitate proper buckling of the expansion assembly in case the ERG encounters debris or some other obstacle that may prevent the expandable assembly from buckling during the first stage of expansion. Under normal operation, the buckling pin 134 travels through the ERG expansion cycle substantially without contacting any surfaces. If resistance to buckling increases, possibly due to debris, wear, or contamination, the resistance can overcome the angular offset mechanical advantage of the joints of the links 118, 120. In instances of increased resistance to buckling, a buckling mechanism comprising a buckling pin 134 and an interfacing flange 135 can provide additional radial force to induce instability and buckle the links. If during the first stage of expansion, the links 118, 120 have not started to buckle, radial movement of the engagement assembly 122 can force the buckling pin 134 to contact a flange 135 or wing of the first link 118. The flange 135 and buckling pin 134 can be sized and positioned to buckle the first link 118 to an expansion angle of about 9° before the buckling pin 134 transitions off of the flange 135. Although the buckling mechanism is depicted with a certain configuration, it is contemplated that the buckling pin could be relocated to one of the links and the interfacing wing relocated to the engagement assembly adjacent the pin, or other structures used to initiate buckling of the links.

Second Expansion Stage

Figure 8:
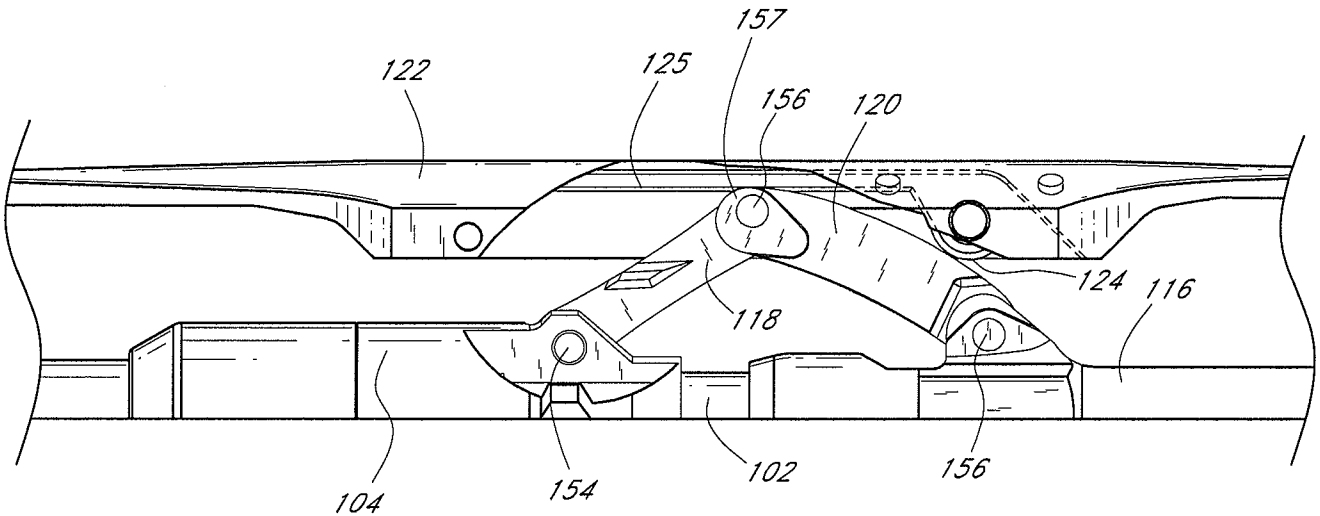
FIG. 8 is a cut away side view of the expandable assembly of the gripper assembly of FIG. 1 in a second stage of expansion.

With reference to FIG. 8, a second stage of gripper expansion commences when the roller 124 transitions from the ramp of the sliding sleeve 116 onto an outer surface of the second link 120. The outer surface of the second link can have an arcuate or cam-shaped profile such that to provide a desired radial force generation by the advancement of the roller along the outer surface of the second link as the expandable assembly continues to buckle. During the second expansion stage, the links 118, 120 can continue to buckle until they reach a maximum predetermined buckling angle defined by the angle between link centerlines.

Third Expansion Stage

Figure 9:
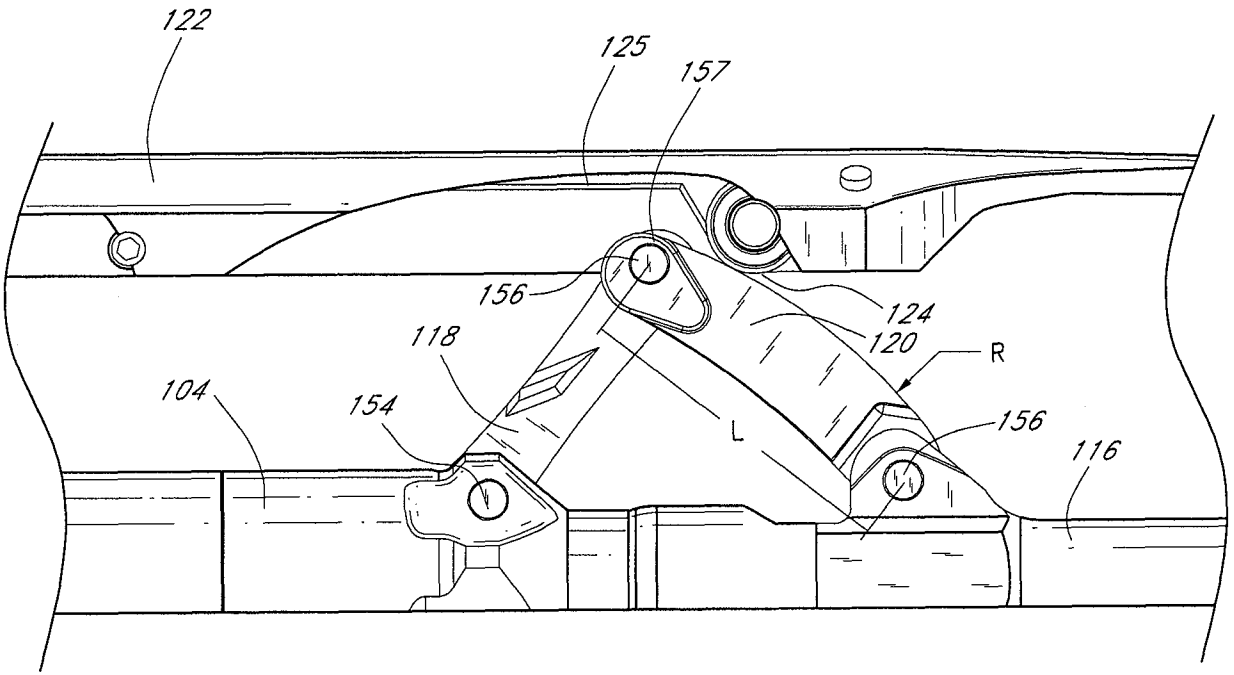
FIG. 9 is a cut away side view of the expandable assembly of the gripper assembly of FIG. 1 in a third stage of expansion.

With reference to FIG. 9, a third stage of expansion of the ERG begins when the first link 118 has risen to a maximum design expansion angle. In the illustrated embodiment, this maximum expansion angle is reached when the operating sleeve 104 contacts the sliding sleeve 116 stopping the links 118, 120 from expanding further. Once maximum buckling of the links 118, 120 has been reached, as the piston 114 continues moving axially downhole, the boss 157 of the second link 120 loses contact with the track 125 on underside of the engagement assembly 122. Thus, in the third expansion stage, interface of the second link 120 with the roller mechanism 124 provides the sole radial expansion force to the engagement assembly 122. As with the second expansion stage described above, the outer profile of the second link 120 determines the tangent angle and the resultant radial force.

Retraction

Once expansion of the ERG is complete, it can be desirable to return the gripper to a retracted configuration, such as, for example to retract a tractor from a passage. It is desirable when removing the gripper from a tractor that the gripper assembly be in the retracted position to reduce the risk that the tractor can become stuck downhole. Thus, the actuator and expandable assembly of the ERG can desirably be configured to provide a failsafe to bias the gripper assembly into the retracted position. As noted above, upon release of hydraulic fluid the spring return in the actuator returns the piston. Thus, the spring returned actuator in the illustrated embodiment of the ERG advantageously provides a failsafe to return the gripper to the retracted configuration. The spring return in the actuator acts on both the operating sleeve 104 and the sliding sleeve 116 to return the expandable assembly into the retracted position. This spring-biased return action on two sides of the expandable assembly returns the expandable assembly to the retracted position. Specifically, the engagement assemblies 122 will collapse as the expandable assembly collapses and the roller 124 moves down the second link 120 onto the ramp of the sliding sleeve 116.

In some embodiments, when an unidentified excessive force or mechanical failure occurs the keys 160, 168 can actively inhibit rotational misalignment of the engagement assembly and the expandable assembly that might otherwise complicate complete retraction of the engagement assembly and expandable assemblies. In the event that the expandable assembly becomes disengaged from the engagement assembly, for example the boss 157 disengages the groove 125, the keys 160, 168 can react against rotation of the piston rod 112. In embodiments wherein the piston rod 112 is keyed to the expandable assembly, such as through the operating sleeve 104, the key 168 preferably reacts against rotational forces to substantially prevent rotation of the expandable assembly relative to the piston rod 112.

Although this application discloses certain preferred embodiments and examples, it will be understood by those skilled in the art that the present inventions extend beyond the specifically disclosed embodiments to other alternative embodiments and/or uses of the invention and obvious modifications and equivalents thereof. Further, the various features of these inventions can be used alone, or in combination with other features of these inventions other than as expressly described above. Thus, it is intended that the scope of the present inventions herein disclosed should not be limited by the particular disclosed embodiments described above, but should be determined only by a fair reading of the claims that follow.

What is claimed is:

1. A gripper assembly, comprising:

an elongate member having a length;

an expandable assembly comprising a linkage and a link mount, the expandable assembly connected to the elongate member for movement between an expanded configuration and a collapsed configuration;

an engagement assembly positioned generally over the expandable assembly such that expansion of the expandable assembly urges at least a portion of the engagement assembly away from the elongate member and connected to the expandable assembly; and an engagement assembly support;

wherein the engagement assembly is coupled with the engagement assembly support, the linkage is coupled with the link mount, and the engagement assembly support is connected to the link mount such that rotation of the engagement assembly support about the length of the elongate member relative to the link mount is restricted to less than approximately 15° without plastic deformation of at least one of the engagement assembly, the expandable assembly, and the elongate member.

2. The gripper assembly of claim 1, wherein rotation of the engagement assembly support about the length of the elongate member relative to the link mount is restricted to less than approximately 10° without plastic deformation of at least one of the engagement assembly, the expandable assembly, and the elongate member.

3. The gripper assembly of claim 2, wherein rotation of the engagement assembly support about the length of the elongate member relative to the link mount is restricted to less than approximately 5° without plastic deformation of at least one of the engagement assembly, the expandable assembly, and the elongate member.

4. The gripper of claim 1, wherein the link mount is an operating sleeve.

5. The gripper assembly of claim 1, wherein the elongate member is a piston rod; and the engagement assembly support and the link mount are each independently coupled with the piston rod such that rotation of the engagement assembly support about the length of the elongate member relative to the link mount is restricted to less than approximately 15° without plastic deformation of at least one of the engagement assembly, the expandable assembly, and the elongate member.

6. The gripper of claim 5, wherein the engagement assembly support and the link mount are each independently coupled with the piston rod by rotational interlocking members.

7. The gripper of claim 6, wherein the rotational interlocking members are interference fit together.

8. The gripper of claim 6, wherein one of the engagement assembly support and the piston rod comprises a male rotational interlocking member and the other comprises a female rotational interlocking member.

9. The gripper assembly of claim 5, further comprising:

a key having a first dimension and a second dimension, the first dimension and the second dimension of the key being unequal;

wherein one of the engagement assembly support and the piston rod comprises an aperture having a first dimension and a second dimension shaped to closely conform to the first dimension and the second dimension of the key, and the other of the sleeve and the piston assembly comprises a slot having a second dimension that closely conforms to the second dimension of the key and the slot having a first dimension that is greater than a first dimension of the key, the key being fixed in the aperture with the key extending at least partially into the slot.

10. The gripper assembly of claim 9, wherein the key is fixed in the aperture by at least one screw.

11. The gripper assembly of claim 9, wherein the second dimension of the slot and the second dimension of the key permit the key to freely slide along the first dimension of the slot.

12. The gripper assembly of claim 9, wherein key is interference fit into the aperture.

13. The gripper assembly of claim 5, further comprising:

a key having a first dimension and a second dimension, the first dimension and the second dimension of the key being unequal;

wherein the key simultaneously extends at least partially through apertures of the link mount and the piston rod to inhibit sliding movement of the sleeve relative to the piston assembly.

14. The gripper assembly of claim 13, wherein key is interference fit into at least one of the apertures.

15. The gripper assembly of claim 14, wherein key is interference fit into both of the apertures.

* * * * *